US006082701A

United States Patent [19]

Reymann

[11] Patent Number: 6,082,701

[45] Date of Patent: Jul. 4, 2000

[54] FORMWORK SYSTEM FOR PREFABRICATED CONCRETE PARTS

[75] Inventor: Wolfgang Reymann, Hockenheim, Germany

[73] Assignee: Reymann Technik GmbH, Hockenheim, Germany

[21] Appl. No.: 09/017,776

[22] Filed: Feb. 3, 1998

Related U.S. Application Data

[63] Continuation of application No. PCT/EP96/03418, Aug. 2, 1996.

[30] Foreign Application Priority Data

Aug. 4, 1995 [DE] Germany ..... 195 28 842

[51] Int. Cl.[7] ..... B28B 7/00

[52] U.S. Cl. ..... 249/160; 249/102; 249/139; 249/155; 249/163; 425/DIG. 33

[58] Field of Search ..... 425/3, DIG. 33; 249/139, 160, 163, 168, 102, 167, 155

[56] References Cited

U.S. PATENT DOCUMENTS

| | | | |
|---|---|---|---|
| 2,503,467 | 4/1950 | Blind . | |
| 3,319,989 | 5/1967 | Ross . | |
| 3,635,642 | 1/1972 | Mueller | 249/160 |
| 3,667,880 | 6/1972 | Malet et al. | 425/3 |
| 3,730,657 | 5/1973 | Malet et al. | 425/3 |

FOREIGN PATENT DOCUMENTS

| | | |
|---|---|---|
| 0 116 476 A2 | 8/1984 | European Pat. Off. . |
| 530 504 A1 | 3/1993 | European Pat. Off. . |
| 1344377 | 10/1963 | France . |
| 2 538 049 A1 | 6/1984 | France . |
| 967 514 | 11/1957 | Germany . |
| 29 07 508 A1 | 9/1980 | Germany . |
| 29 07 508 C2 | 7/1990 | Germany . |
| 93 00 658 U | 6/1993 | Germany . |
| 92 18 032 U | 7/1993 | Germany . |
| 43 27 696 A1 | 2/1995 | Germany . |

*Primary Examiner*—James P. Mackey

*Attorney, Agent, or Firm*—Akin, Gump, Strauss, Hauer & Feld, L.L.P.

[57] ABSTRACT

A formwork system for prefabricated concrete parts has a baseplate (1) on which is mounted a magnet element (2A) which holds formwork or attachment elements in their positions. In order to enable such formwork or attachment elements to be handled more easily, they are equipped with a lifting frame (14) which overlies the magnet element (2A) and, on the side of the magnet element (2A) facing away from the baseplate (1), there is a gap (19) between the magnet element (2A) and the lifting frame (14). A suitably designed spring device (25) in the lifting mechanism can be used, after zeroing, to enable lifting to be carried out automatically.

15 Claims, 5 Drawing Sheets

12
14A
13
19
7
5
8
11
II
II
21
2
14
2A
1
3
20
18
21
10
12
4
6
9

FORMWORK SYSTEM FOR PREFABRICATED CONCRETE PARTS

CROSS REFERENCE TO RELATED APPLICATION

This application is a continuation of International Application PCT/EP96/03418, Filed Aug. 2, 1996.

BACKGROUND OF THE INVENTION

The invention concerns a formwork system for concrete parts with a base plate on which a magnet element can be placed which fixes the formwork and attachment parts in their respective positions.

A formwork system of this type is known from DE-OS 43 27 696. Such formwork systems are used in production facilities for prefabricated concrete parts. They have the advantage that no drillings or the like must be present in the base plate for attaching formwork for concrete parts of various size to the same base plate. Instead of this, a form of the desired size is assembled on the base plate, usually made of steel, and the individual formwork elements are then joined with magnets by appropriate bracing or coupling elements, which are installed adhering to the base plate.

A formwork system as indicated above was refined as described in DE-93 00 658 or DE-U-92 18 032, in that the form elements have a lifting frame overlying the magnets, whereby on the side of the magnet element facing away from the base plate, there is a gap between the magnet element and the lifting frame into which gap the element can be retracted.

Thus, in removing forms, the formwork element can be lifted from the base plate together with the magnet element, which means a considerable simplification of form removal, which can now take place in one operation.

In contrast, previously it was necessary to remove the formwork and the magnet element from the base plate separately which entailed a considerably greater expenditure of work. In particular, with the described configuration of the formwork system, the formwork and the magnet element are be brought together to a central cleaning station where they are cleaned for a reuse, while prior to this, separate transport facilities had to be provided for the magnet element in each case.

For construction, it is proposed in DE-U-92 18 032 that the magnet element be provided with a boring in which a lifting mechanism then engages bracing itself on the lifting frame. The magnet element can be safely retracted into the lifting frame with this lifting mechanism.

Here the lifting mechanism can, for example, have a screw thread, so that by rotating, the magnet element is hoisted. At the same time, one can combine this thread with a tapped hole in the lifting frame as well as with a tapped hole in the magnet element. The tool necessary to rotate the lifting mechanism is usually available at all construction sites in the form of a wrench or spanner.

Subsequent detachment of formwork elements is then relatively expensive, especially also because the magnets which then adhere with their full surface on the base plate can only be removed from it with difficulty.

BRIEF SUMMARY OF THE INVENTION

From this background arises the object of further developing a formwork system as indicated above, such that it is also easy to handle when its use has finished.

This object is accomplished in accordance with the invention in that the formwork elements have a lifting frame engaging over the magnets, wherein on the side of the magnet element facing away from the base plate there is a gap between the magnet element and the lifting frame into which gap the magnet element is retractable.

The object is accomplished in accordance with the invention by bracing the lifting mechanism on the lifting frame while interposing a spring which then, in particular, has a tension which is less than the adhesion force of the magnet element set on the base plate. With such a form of construction, the magnet element is at least unilaterally lifted from the base plate owing to an easy hoisting of the magnet element, whereby the still existing attractive forces of the magnet element for the base plate are considerably smaller than the adhesion forces of the magnet element lying flat on the base plate. The further raising of the magnet element from the base plate and its retraction into the lifting frame can thereby take place automatically. The spring can be, for example, a coil spring or a stack of cup springs.

In this connection, it has proven advantageous for the lifting frame to be constructed as an integral component of the formwork. This makes possible a very compact type of construction, and the formwork therefore can also be stacked better when not in use and can consequently be stored better.

As an alternative, the lifting frame can also be attached interchangeably on the formwork. This makes possible its simpler cleaning on the one hand. On the other hand, a lifting frame can also be used with different forms, whereby the costs of the forms can be reduced. If one considers here that a majority of the forms are maintained in storage respectively only for contingencies, then a considerably lesser capital tie up can be attained by this storage.

At the same time, it is beneficial to fasten the lifting frame to the formwork by means of an adapter guide which equalizes different form heights. The same lifting frame with accompanying magnet element can therefore be used independently of the remaining dimensions of the form.

For construction, it is proposed in accordance with the invention that the magnet element be provided with a boring in which a lifting mechanism then engages bracing itself on the lifting frame. The magnet element can be safely retracted into the lifting frame with this lifting mechanism.

The conditions under which the device of the invention is used are very severe, as is generally known. Thus, individual parts can often come into contact with liquid concrete, which easily attaches itself to them, so that the parts can be subjected to a strongly abrasive stress when they rub against one another. Under this aspect, it is advantageous that the boring for the lifting mechanism present on the magnet element, as described above, be provided with a thread which is located on an interchangeable section of the magnet element. It is thus achieved that it can easily be changed if perhaps it is dirty, worn, or no longer usable for other reasons.

It is indeed possible to provide this interchangeable section in the center of the magnet element. More advantageously, however, the lifting devices will engage on the ends of the magnet element, since in this way especially favorable lifting and force conditions can be attained.

For this reason, the interchangeable section provided with a thread is also arranged on the end of the magnet element, which facilitates its ability to be removed and replaced. This is especially the case when the exchangeable section is arranged within a U-shaped shell surface of the magnet element constructed open toward the base plate, from which it can be laterally withdrawn for exchange. Especially since in the area of the exchangeable section the legs of the shell surface diminish at least locally in their clear spacing to each other, it is prevented that the interchangeable section can unintentionally fall downward out of the magnet element.

Since the exchangeable section is at the same time also made of a material which is attracted by the magnets in the magnet element, it is also prevented from falling out laterally. At the same time, however, the forces from the magnets acting on the interchangeable section can be so large that an interstice is provided in the magnet element for inserting a parting tool between the interchangeable section and the magnets bordering on these. With the parting tool, for example a screwdriver, the interchangeable section is then pried away from the magnet.

The above-mentioned boring through the magnet element or through the interchangeable section is advantageously a through boring, so that no dirt collects in it, but rather falls through this boring. This has the advantage that the lifting mechanism interacting with the magnet element via a screw thread can also be screwed against the base plate. In this fashion the magnet can be lifted from the base plate. The lifting mechanism is then merely guided by the lifting frame.

If the magnet element is thereby only raised at one end, it is advantageous if the magnet element has a roller edge at the other end, by means of which it still lies on the base plate when it is lifted on one side, to prevent a point stress of the base plate with high Hertzian stress from occurring in this resting position. With an appropriate construction of the formwork system, in which the two ends mentioned are respectively provided with lifting mechanisms braced on the lifting frame with springs, it is also achieved with this constellation that the adhesion strength between the magnet element and base plate is eliminated by the one-sided raising of the magnet body, and only the lesser attractive force is still acting between these, so that the springs are then in a position to lift the magnet element from the base plate automatically.

That means that the magnet element is automatically retracted into the above-mentioned gap within the basically U-shaped lifting frame overlying it in the form of a tunnel sitting on the base plate, whereby it also comes to lie within the lifting frame overlying it.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
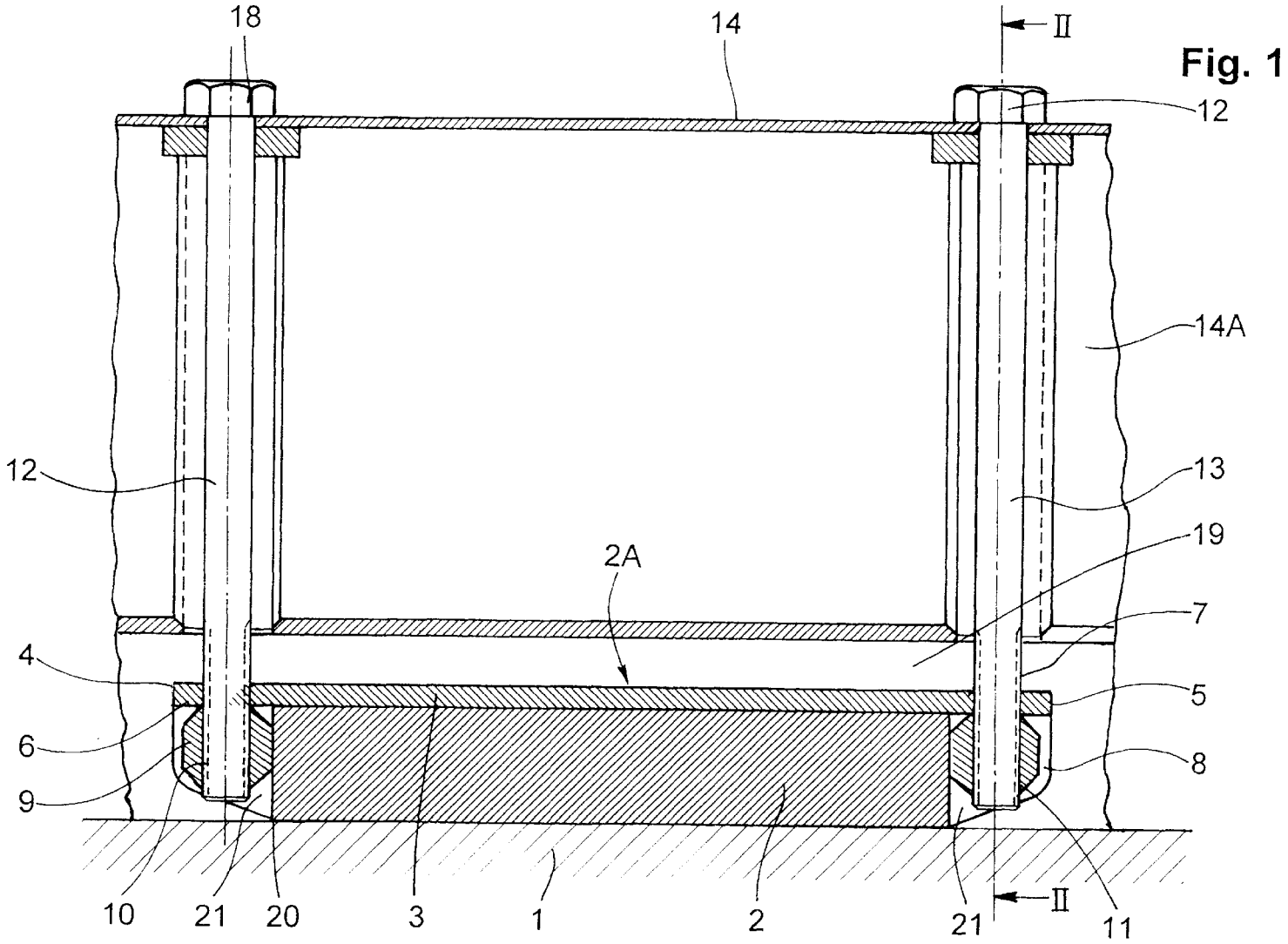
FIG. 1 is a longitudinal section through a formwork system.
Figure 2:
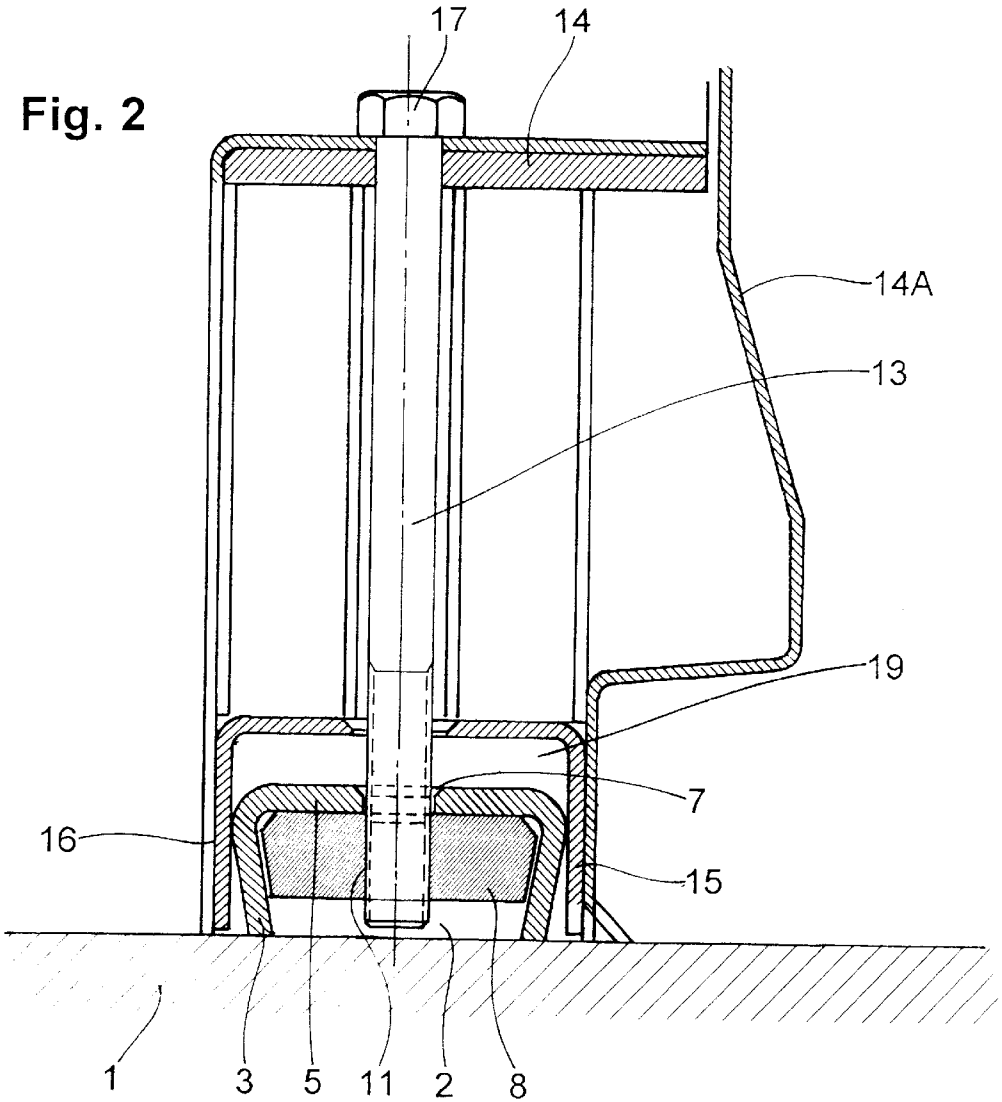
FIG. 2 is a section through a formwork system along line II—II in FIG. 1.

A formwork system of the invention is represented in FIGS. 1 and 2 with lifting mechanisms which are provided with a screw thread. On a base plate 1 which is made of steel and is consequently magnetic, a magnet 2 is mounted which is fixed firmly and immovably on the base plate 1 through its magnetic adhesion forces. The magnet 2 is a component of a magnet element 2A, in with which the magnet 2 is surrounded by a U-shaped shell surface 3 constructed open downwardly toward the base plate. This shell surface 3 projects beyond the magnets 2 lying inside at the ends 4, 5 of the magnet element. The shell surface is provided with bore holes 6, 7 in these areas. Situated below these bore holes 6, 7 are interchangeable sections 8, 9 which likewise have borings which, however, are provided with screw threads 10, 11 in contrast to bore holes 6, 7.

Lifting mechanisms 12, 13 provided with threads run through the bore holes 6, 7 and the borings of the interchangeable sections 8, 9 provided with screw threads 10, 11. These lifting mechanisms are braced on a lifting frame 14, which is an integral component of a formwork 14A.

The previously described formwork system with its elements functions as follows:

In order to make a concrete part (in FIG. 2, lying to the right of the formwork 14A), a plurality of magnet elements 2A are laid over their magnets 2 on the base plate 1. The form 14A is then placed over the magnet element 2A which determines the dimensions of the prefabricated concrete part, such that flanges 15, 16 push past laterally with an exact fit on the shell surface 3 of the magnet body 2*a* and thereby fix the position of the formwork 14A in relation to the magnet body 2A. Then the lifting mechanisms 12, 13 are inserted through the formwork 14A or the lifting frame 14 incorporated into these. The lifting mechanisms are constructed as screws with hexagon heads 17, 18 in the example represented here. The lifting mechanisms 12, 13 are screwed on their lower end into the thread 10, 11 of the interchangeable section 8, 9 to which the magnet element 2A is to be allocated. The form 14A is thereby drawn against the base plate 1. A torque wrench applied to the hexagon head thereby assures that the traction exerted on the magnets 2 by the lifting mechanisms 12, 13 does not become higher than the lift-off force for the magnets 2.

The prefabricated concrete part is then poured. When the concrete of the prefabricated part has hardened, the formwork 14A must be separated from the base plate 1 again. For this, one of the lifting mechanisms, for example lifting mechanism 13, is drawn beyond the torque mentioned above, whereupon the end 5 of the magnet element 2A rises from the base plate 1 and is retracted into a gap 19, which is formed between the side of the magnet element 2A facing away from the base plate 1 and the lifting frame 14. With this lifting on one end, the magnet element 2A pivots on the opposite end 4 around a roller edge 20, which then forms a line contact between the magnet element 2A and the base plate 1.

After the magnet element 2A no longer has adhesion contact with the base plate 1 on its entire surface, only the magnetic attractive force (which is considerably lower than the previously prevailing adhesion force) is still acting between it and the base plate 1. Consequently, the magnet element 2A can now easily be separated from the base plate 1 by raising the end 4 which has not yet been lifted. The formwork 14A can then be removed from the finished concrete part without further ado (in FIG. 2, to the left).

The lifting mechanisms 12, 13 are then screwed out of the threads 10, 11 of the interchangeable sections 8, 9, and the magnet elements 2A can then be reused. Prior to this, however, they are usually cleaned.

Owing to environmental influences the threads 10, 11 in the interchangeable sections are exposed to severe wear. That means that the lifting function, as described above, is not guaranteed over the long run, since corrosion can easily occur in the threads. A magnet element 2A as represented here can, however, be reused merely by removing the interchangeable section 8, 9 and replacing it by a new one which has a new, unworn thread.

So that such a section 8, 9 is not unintentionally lost, it must be attached to the magnet element 2A. On the one hand, this occurs in that the shell surface 3 is slightly tapered downwardly in the area of the interchangeable sections 8, 9 (see FIG. 2), so that with this, the interchangeable section 8, 9 cannot fall out of the otherwise open shell surface in this direction. The interchangeable section 8, 9 is secured toward the still open end surface (lying toward the front in FIG. 2) by the magnets 2. Thus, the interchangeable sections 8, 9 are specifically made of simple steel (especially also for cost reasons) which is attracted by the magnets 2, whereby the interchangeable sections 8, 9 are also fixed in this direction.

In order nonetheless to be able to separate the interchangeable sections 8, 9 from the magnets 2, they are provided on the boundary surface with an interstice 21 into which a parting tool can be pushed.

One thereby obtains a magnet element 2A which can be reused again and again, wherein its thread sections 8, 9, which are subject to wear, can simply be exchanged. It is obvious that this is a considerable economic advantage.

Basically, such a magnet element 2A can also be used on a base plate 1 without the formwork 14 described above. Then a known bracing or coupling element is connected with the magnet element 2A through one of the bore holes 8, 9 provided with threads 10, 11.

For the corresponding detachment of such a magnet body 2A from the base plate after use, a lifting mechanism 13 passing through the thread 11 is screwed in so far that it lies against the base plate 1. Upon a further screwing in, the end 5 of the magnet element 2A would then be raised and pivoted about the roller edge 20, as described above, so that the magnet element 2A can then be easily removed from the base plate 1, owing to the lesser magnetic attractive force (in relation to adhesion force) which alone is still operating in this position.

Figure 3:
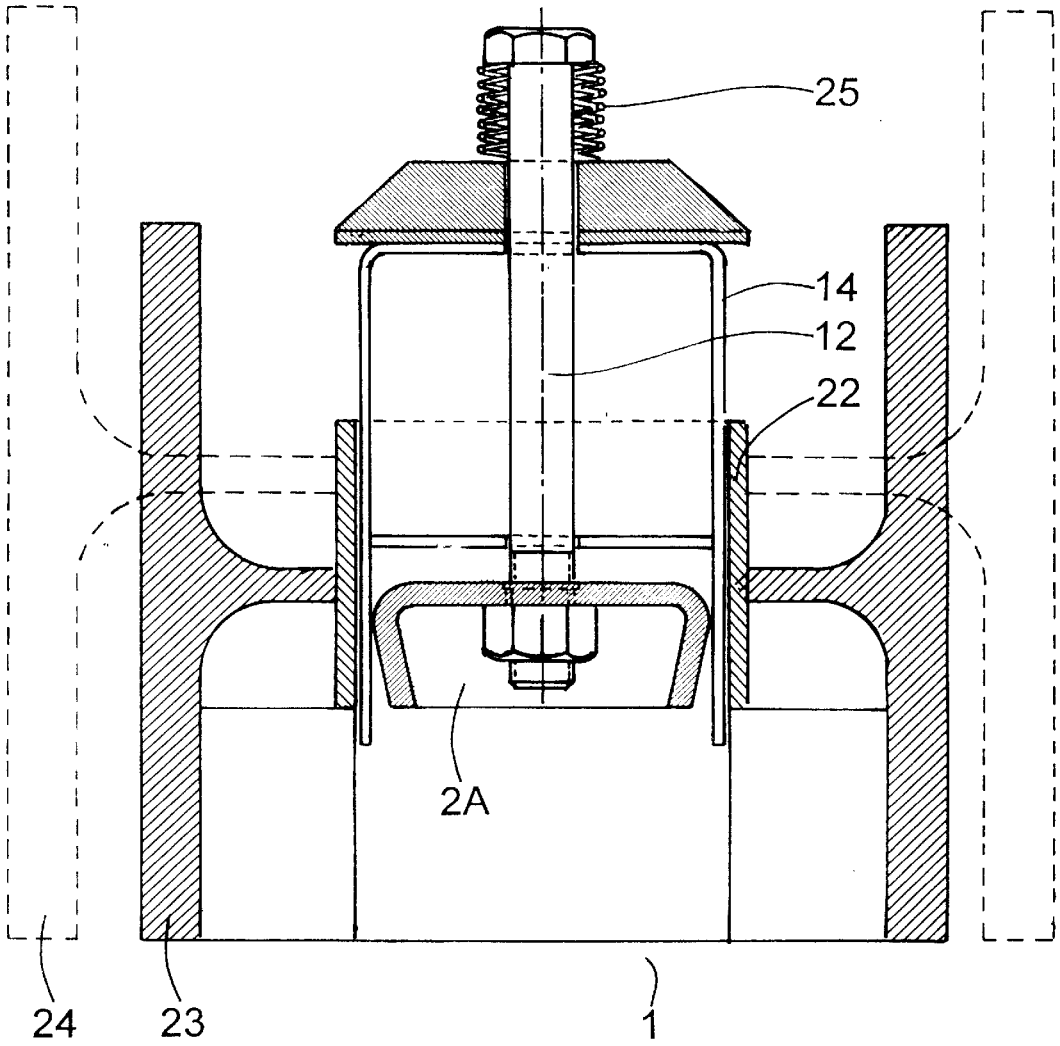
FIG. 3 is a section through a formwork system, according to the invention with spring-braced lifting mechanism and a lifting frame interchangeably fastened to the formwork.

In FIG. 3, a formwork system of the invention is represented. There the lifting frame 14 is inserted into an adapter guide 22 with an exact fit. The lifting frame 14 is to be removed in an upward direction from this adapter guide 22. The adapter guide 22 is incorporated into a formwork 23 constructed in an H-shaped manner, represented by cross-hatching, whereby it should be recognized through a contour 24 represented with dotted lines that an adapter guide 22 can be used with H-shaped formworks 23 of varying size, which are respectively incorporated into the formwork at various depths, but always with the same height above the base plate 1.

Moreover, it should be recognized in the example represented in FIG. 3 that the lifting mechanisms 12 are braced on the lifting frame 14 by springs 25 in the form of a package of cup springs. When the lifting frame is raised from the base plate 1, as represented in FIG. 3, these springs are slack.

Figure 4:
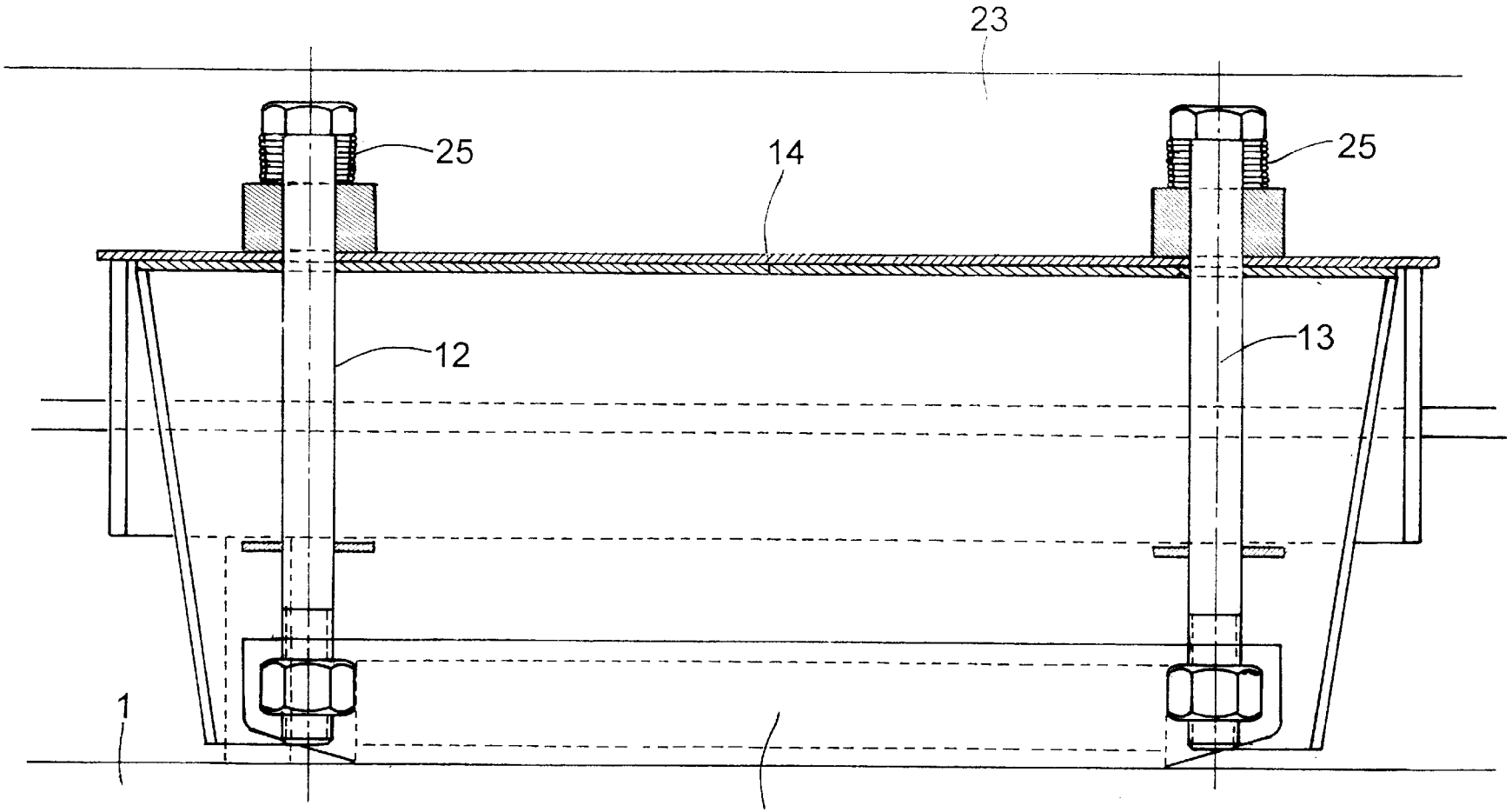
FIG. 4 is a side view through the formwork system of the invention in accordance with FIG. 3.

If the magnet element 2A is set on the base plate 1, as represented in FIG. 4, the springs 25, by means of which the lifting mechanisms 12 and 13 are braced on the lifting frame, are under tension. Nevertheless, the tension of these springs 25 is less than the adhesion force of the magnet element 2A on the base plate 1.

Figure 5A:
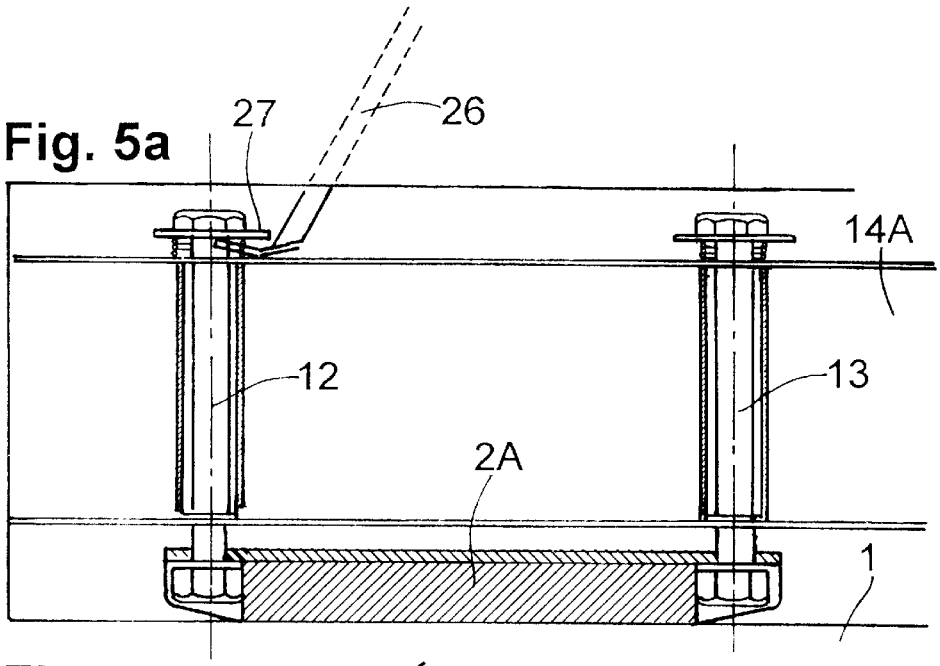
FIG. 5*a* shows the magnet element fully engaged with the base plate.
Figure 5B:
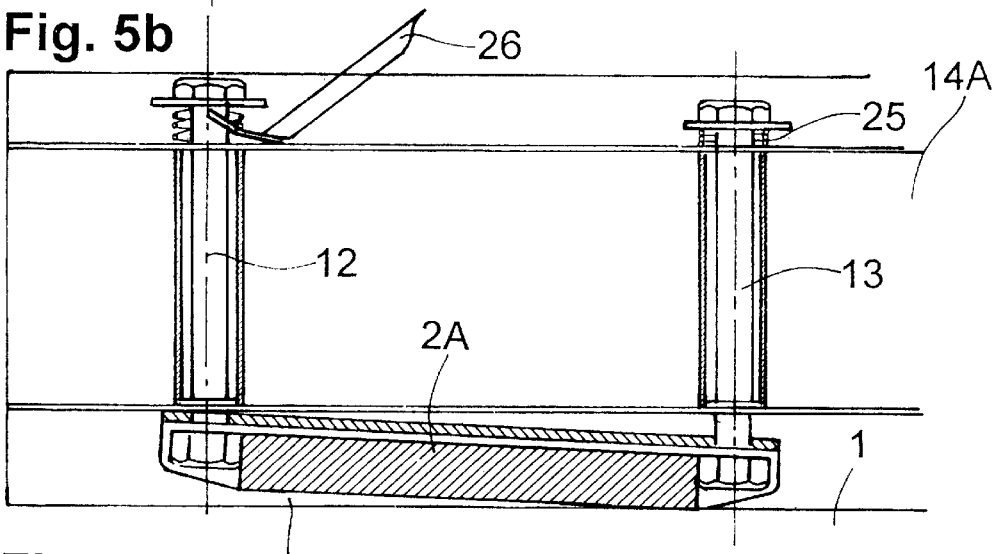
FIG. 5*b* shows the magnet element partially engaged with the base plate.
Figure 5C:
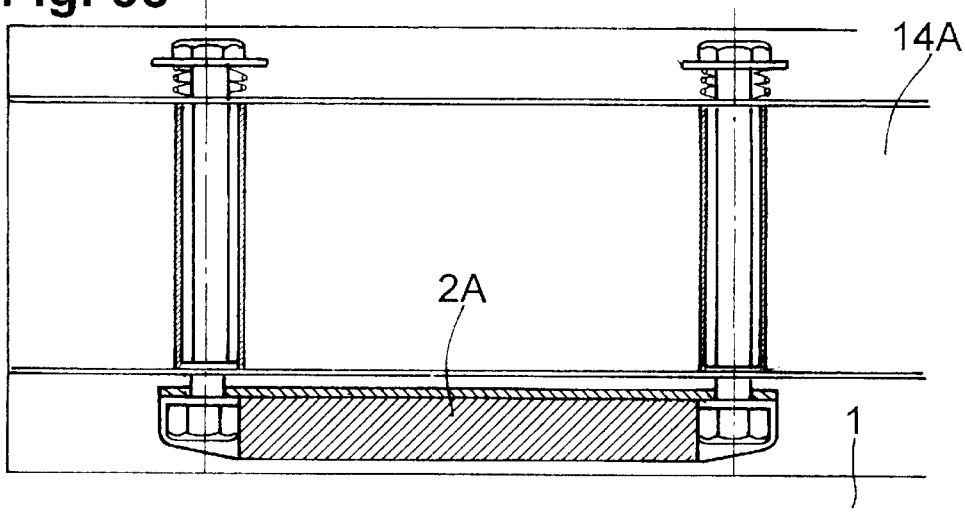
FIG. 5*c* shows the magnet element disengaged from the base plate.

How the detachment of the magnet element 2A from the base plate 1 takes place is represented in FIGS. 5*a* to 5*c*. One of the two lifting mechanisms 12, 13 is raised with an appropriate lever 26, which is set under a corresponding disk 27 (FIG. 5*a*), whereby the magnet element 2A lying flat on the surface of the base plate 1 is raised on one side. As a result, there arises a wedge-shaped gap 28 between the underside of the magnet element 2A and the base plate 1 (FIG. 5*b*). At the same time, this gap 28 has the effect that the magnet 2 no longer adheres with its full adhesive force to the base plate 1, but only exerts a lesser magnetic attractive force between these. This has as a consequence that the corresponding spring 25 on the other lifting mechanism can likewise pull the lifting mechanism 13 upwardly, whereby the magnet element 2A, as represented in FIG. 5*c*, is completely lifted from the base plate 1.

The form can then be removed, as described above, and be used again after appropriate cleaning. If necessary, the formwork 14A is also, however, stored until it is used again. Then, the magnet element 2A with the accompanying lifting frame 14 is removed from the corresponding adapter guide 22 of the formwork 14A, and is inserted into another adapter guide of another form.

By pressing the two lifting mechanisms 12, 13 downwardly at the same time, it is ensured in the opposite case that the magnet element 2A comes to lie flat on the base plate 1, consequently adhering firmly to the base plate 1, and thus being able to firmly anchor the formwork 14A on the base plate 1.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A formwork system to fabricate concrete parts, comprising a base plate (1) and a magnet element (2A) detachably securing a formwork part (14A) in a position on the base plate (1), the formwork part (14A) having a lifting frame (14) overlying the magnet element (2A), and a gap being provided on a side of the magnet element (2A) facing away from the base plate (1) between the magnet element (2A) and the lifting frame (14), into which gap the magnet element (2A) is retractable, wherein the magnet element (2A) has a boring (6, 7) in which a lifting mechanism (12, 13) braced on the lifting frame (14) engages, and wherein a spring (25) is interposed between the lifting mechanism (12, 13) and the lifting frame (14).

2. The formwork system in accordance with claim 1, wherein the lifting frame (14) is an integral component of the formwork part (14A).

3. The formwork system in accordance with claim 1, wherein the lifting frame (14) is interchangeably fastened on the formwork part (23, 24).

4. The formwork system in accordance with claim 3, wherein the lifting frame (14) is fastenable to the formwork part (23, 24) via an adapter guide (22) which allows the lifting frame (14) to be operated in conjunction with one of a variety of different formwork parts each having different heights.

5. The formwork system in accordance with claim 1, wherein the spring (25) has a tension force which is less than an adhesion force of the magnet element (2A) set upon the base plate (1).

6. The formwork system in accordance with claim 1, wherein the lifting mechanism (12, 13) has a screw thread (10, 11).

7. The formwork system in accordance with claim 1, wherein the boring (6, 7) is provided with a screw thread (10, 11) and is located on an interchangeable section (8, 9) of the magnet element (2A).

8. The formwork system in accordance with claim 7, wherein the interchangeable section (8, 9) is arranged on an end (4, 5) of the magnet element (2A).

9. The formwork system in accordance with claim 7, wherein the interchangeable section (8, 9) is arranged within a U-shaped shell surface (3) of the magnet element (2A) constructed open toward the base plate (1).

10. The formwork system in accordance with claim 9, wherein a clear spacing of legs of the U-shaped shell surface (3) to one another decreases at least locally in an area of the interchangeable section (8, 9).

11. The formwork system in accordance with claim 7, wherein the interchangeable section (8, 9) comprises a magnetic material, and an interstice (21 ) for inserting a parting tool is present between the interchangeable section (8, 9) and a magnet (2) adjacent to the interchangeable section in the magnet element (2A).

12. The formwork system in accordance with claim 1, wherein the boring (6, 7) is a through bore.

13. The formwork system in accordance with claim 7, wherein the lifting mechanism (12, 13) engages the screw thread (10, 11) and is adapted to be screwed in such that a surface of the lifting mechanism lies against the base plate (1).

14. The formwork system in accordance with claim 1, wherein the magnet element (2A) has a roller edge (20) on an end (4, 5) opposite the boring (6, 7) on its side facing the base plate (1).

15. The formwork system in accordance with claim 1, wherein the magnet element (2A) has borings (6, 7) at two opposite ends with lifting mechanisms (12, 13) engaging therein.

* * * * *